United States Patent [19]

Henkel

[11] 4,143,876

[45] Mar. 13, 1979

[54] ARROWHEAD WITH REPLACEABLE AUXILIARY BLADE

[76] Inventor: Edward J. Henkel, Rte. 1, Bartlett Rd., Williamsburg, Mich. 49690

[21] Appl. No.: 780,779

[22] Filed: Mar. 24, 1977

[51] Int. Cl.[2] ..... F41B 5/02

[52] U.S. Cl. ..... 273/106.5 B

[58] Field of Search ..... 273/106.5 R, 106.5 B

[56] References Cited

U.S. PATENT DOCUMENTS

| | | | |
|---|---|---|---|
| 2,373,216 | 4/1945 | Zwickey | 273/106.5 B |
| 2,829,894 | 4/1958 | Henkel | 273/106.5 B |
| 2,864,618 | 12/1958 | Schwenk | 273/106.5 B |
| 3,618,948 | 11/1971 | McGlocklin | 273/106.5 B |
| 3,995,860 | 12/1976 | Manspeaker | 273/106.5 B |

*Primary Examiner*—Paul E. Shapiro
*Attorney, Agent, or Firm*—Willis Bugbee

[57] ABSTRACT

This hunting arrowhead has a pair of opposed flanged longitudinally-slotted ferrule halves with a slotted main blade held between them and a tapered socket rearwardly thereof for receiving the end of the shaft. Insertable by a sliding motion into the slots in the ferrule halves is a generally triangular auxiliary blade having a continuous and unbroken rim and containing an elongated narrow tapered slot into which snap lugs or wings along one edge of the ferrule slots which are otherwise of elongated narrow pointed shape. The rearward end of the auxiliary blade terminates in a truncated obtuse-angled end which, when the auxiliary blade is fully seated in the ferrule slots, lies close to the rearward blunt ends of the ferrule slots. A dull or damaged auxiliary blade is removed and replaced by reversing the sliding motion employed in its insertion.

7 Claims, 7 Drawing Figures

ARROWHEAD WITH REPLACEABLE AUXILIARY BLADE

BACKGROUND OF THE INVENTION

In the hunting arrowhead of my previous invention disclosed and claimed in my U.S. Pat. No. 2,829,894 issued Apr. 8, 1958 for Arrowhead, the auxiliary blade had a discontinuous periphery in that it possessed a large central opening with a portion thereof leading rearwardly through its rearward end, which thereby resulted in the formation of a pair of rearwardly and inwardly-extending arms separated by a gap, the edges of which engaged the main arrowhead ferrule. In use, however, it was found that, upon striking an animal, the impact caused the auxiliary arrowhead to rotate in the ferrule slots, whereupon the thus-exposed and projecting arms and the adjacent gap between them became clogged with animal hair and skin which reduced the penetration of the arrowhead. The present invention completely solves this problem and removes this difficulty.

SUMMARY OF THE INVENTION

The invention principally resides in the combination of the elongated narrow tapered ferrule slots with their detent lugs for receiving and gripping an edge portion of the elongated narrow forwardly tapered slot in the auxiliary blade in response to a rearwardly sliding motion thereof, thereby enabling the latter to be inserted or removed by said sliding motion.

Figure 1:
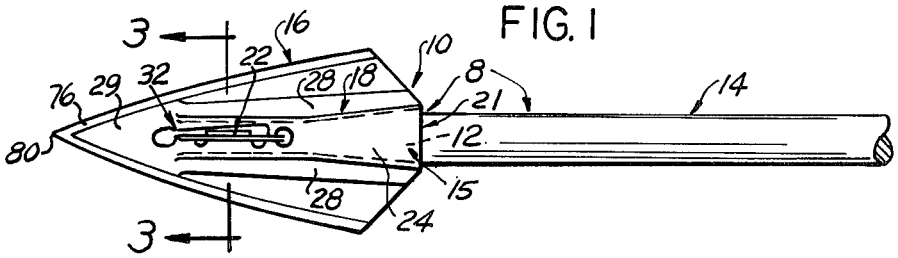
FIG. 1 is a top plan view of an arrowhead with a main blade and a replaceable auxiliary blade according to one form of the invention as mounted on an arrow shaft.
Figure 2:
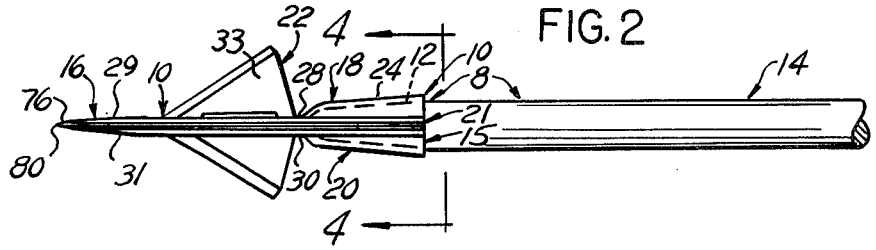
FIG. 2 is a side elevation of the arrowhead shown in FIG. 1.
Figure 4:
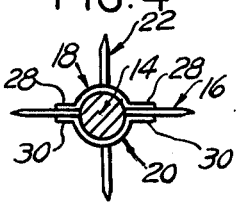
FIG. 4 is a rear elevation partly in cross-section through the arrow shaft, taken along the line 4—4 in FIG. 2.

Referring to the drawing in detail, FIGS. 1 and 2 show generally an archery arrow, generally designated 8, as including a double-bladed arrowhead, generally designated 10, mounted on the tapered forward end 12 of an arrow shaft 14 and provided with a roughly triangular main blade 16 mounted between the longitudinally slotted ferrule halves 18 and 20 of a ferrule 21. Insertably and removably mounted between the slotted ferrule halves 18 and 20 and the also slotted main blade 16 is a roughly triangular auxiliary blade, generally designated 22, with a truncated obtuse-angled rearward edge 23 with a flat end 25. The ferrule halves 18 and 20 have tapered rearward portions 24 and 26 respectively (FIG. 2) of semi-circular cross-section and approximately semi-conical configuration with parallel spaced flanges 28 and 30 disposed in spaced parallel relationship with the main blade 16 held between them and secured thereto in any suitable way, such as by spotwelding. As will be seen from FIGS. 1 and 2, the flanges 28 and 30 extend forward from the tapered portions 24 and 26 and become substantially parallel flat forward end portions 29 and 31 provided with aligned elongated tapered slots, generally designated 32 shown in their normal sizes in FIG. 1 and in a greatly enlarged or magnified scale in FIG. 7.

Figure 5:
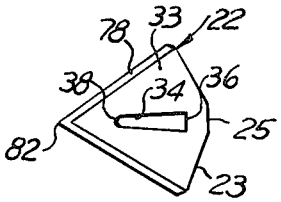
FIG. 5 is a side elevation of the auxiliary arrowhead blade of FIGS. 1 and 2 removed from the arrowhead.
Figure 6:
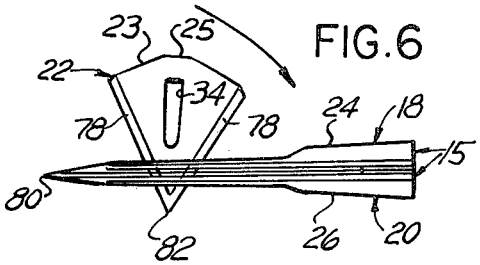
FIG. 6 is a diagrammatic view similar to FIG. 2 but showing the auxiliary arrowhead in an intermediate position during its insertion.
Figure 7:
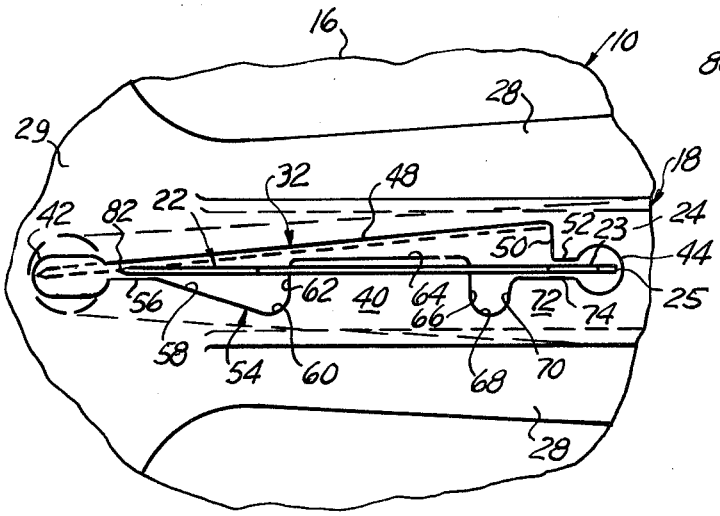
FIG. 7 is a greatly magnified top plan view of the slotted portion of FIG. 1 with the auxiliary blade in position therein.
Figure 3:
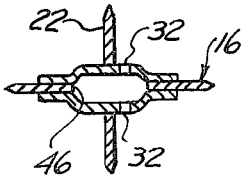
FIG. 3 is an enlarged cross-section taken along the line 3—3 in FIG. 1.

The auxiliary blade 22 (FIGS. 5 and 6) is shorter and thinner than the ferrule slots 32. It also has a continuous unbroken and closed periphery 33 surrounding an elongated narrow forwardly tapered central slot 34 with a squared rearward end 36 and a rounded forward end 38. The tapered slots 34 is adapted to receive and its converging opposite edges grippingly engage inwardly-projecting forward lugs 40 in response to the rearward sliding of the auxiliary blade 22 during its insertion. The lugs 40 lie approximately midway between the forward and rearward end openings 42 and 44 respectively of the ferrule slots 32. The upper ferrule slot 32, of which only the one in the upper ferrule half 18 is shown in FIG. 7, is duplicated in the lower ferrule half, hence a single description will suffice for both. Between them the main blade 16 is provided with an elongated slot 46 (FIG. 3) of sufficient length and width to provide sufficient clearance for the sideways insertion and subsequent rearward longitudinal sliding of the auxiliary blade 22. The ferrule slots 32 are of sufficiently greater length than the auxiliary arrowhead 22 to permit the insertion and rearward seating of the latter, as explaind below.

Each of the ferrule half slots 32 is of a distinctive shape or outline with a rectilinear portion 48 extending obliquely outward between the elongated oval forward end opening 42 and the circular rearward end opening 44 with an approximately perpendicular portion 50 at the rearward end of the straight oblique portion 48. A short axial portion 52 connects the perpendicular portion 50 to the circular end opening 44. The opposite edge, generally designated 54 (FIG. 7), has a short axial portion 56 connecting the rearward end of the forward opening 42 with the forward end of an oblique edge portion 58. The latter is joined by an arcuate portion 60 to a perpendicular portion 62 forming the forward edge of the elongated lug 40. The lug 40 has an elongated axial edge 64 which terminates at its rearward end in a perpendicular edge portion 66 extending outward to an arcuate portion 68 which joins the perpendicular edge portion 66 to the perpendicular forward edge 70 of a shorter rearward lug 72 with an axial forward edge 74 parallel to the elongated edge 64 of the forward lug 40. The rearward lug 72 terminates at the circular rearward opening 44 of the slot 32. The main and auxiliary blades 16 and 22 have sharpened edges 76 and 78 respectively meeting at pointed ends or tips 80 and 82 respectively.

In the operation of the invention, let it be assumed that the arrow 8 is equipped with a main blade 16 and that it is desired to insert an auxiliary blade 42. To do so, (FIG. 6), the user grasps the auxiliary blade 22 between his thumb and forefinger, inserts the pointed tip 82 thereof into the uppermost ferrule slot 32 and thence pushes it downward through the elongated oval forward opening 42 of the upper ferrule slot 32 (FIG. 7), with the remainder of the auxiliary blade 22 tilted against the oblique edge 48 of the slot 32 as indicated by the dotted lines in FIG. 7. He then swings the auxiliary arrowhead 22 toward the opposite edges 54 of the upper and lower ferrule slots 32 while sliding it rearwardly in the slots 32 so that the elongated lugs 64 snap into the auxiliary blade slot 34 as the rearward end 23 of the blade moves into the rearward circular openings 44 of the slots 32 and the flat 25 comes to rest therein. At the same time, the lugs 40 grip the converging edges of the tapered slots 34 of the auxiliary blade 22 while the shorter rearward lugs 72 serve as stops to limit the sidewise motion of the auxiliary blade 22. When the auxiliary blade 22 becomes damaged, or its edges 78 become dull and bent, its replacement is achieved by reversing the foregoing procedure.

I claim:

1. An arrowhead, comprising an elongated ferrule having a rearward socket adapted to receive the forward end of an arrow shaft and having a forward portion with a main blade mounted thereon and having an intermediate portion with a pair of transversely-aligned slots therein disposed transverse to said main blade and extending longitudinally through said ferrule.

said main blade having an opening therethrough disposed substantially in alignment with said slots, and an approximately triangular auxiliary blade which is shorter and thinner than said slots having a longitudinally-elongated forwardly-tapering central aperture therein and an unbroken peripheral portion extending continuously around said central aperture, at least one of said slots having a detent projection extending inward from one edge thereof into said central aperture into gripping engagement with said forwardly-tapering edge portion thereof in response to the rearward sliding of said auxiliary blade during the insertion of said auxiliary blade.

2. An arrowhead, according to claim 1, wherein the other of said slots also has a detent projection extending inward from another edge portion thereof into said central aperture into gripping engagement with said forwardly-tapering edge portion thereof in response to the rearward sliding of said auxiliary blade during the insertion of said auxiliary blade.

3. An arrowhead, according to claim 1, wherein at least one of said slots also has a blade-locating projection extending inward from one edge thereof into engagement with said peripheral portion.

4. An arrowhead, according to claim 3, wherein said one slot has its edge opposite said one edge extending obliquely away from said one edge and has a second projection extending inward from said obliquely-extending edge toward said blade-locating projection in spaced relationshp therewith for the reception of said auxiliary blade therebetween.

5. An arrowhead, according to claim 1, wherein said one slot has its edge opposite said one edge extending obliquely away from said one edge.

6. An arrowhead, according to claim 1, wherein said one slot has an enlargement thereof at one end thereof.

7. An arrowhead, according to claim 1, wherein said one slot has an enlargement thereof at both ends thereof.

* * * * *